US011168422B1

(12) United States Patent
Martelli

(10) Patent No.: US 11,168,422 B1
(45) Date of Patent: Nov. 9, 2021

(54) PRESSER FOOT TUBE MAKER APPARATUS AND METHOD

(71) Applicant: John D. Martelli, Pensacola, FL (US)

(72) Inventor: John D. Martelli, Pensacola, FL (US)

( * ) Notice: Subject to any disclaimer, the term of this patent is extended or adjusted under 35 U.S.C. 154(b) by 678 days.

(21) Appl. No.: 15/813,372

(22) Filed: Nov. 15, 2017

Related U.S. Application Data

(60) Provisional application No. 62/424,412, filed on Nov. 19, 2016.

(51) Int. Cl.

| | |
|---|---|
| ***D05B 29/08*** | (2006.01) |
| ***D05B 29/12*** | (2006.01) |
| ***D05B 35/08*** | (2006.01) |
| ***D05B 35/10*** | (2006.01) |
| ***D05B 35/00*** | (2006.01) |

(52) U.S. Cl.
CPC ..... *D05B 29/08* (2013.01); *D05B 29/12* (2013.01); *D05B 35/00* (2013.01); *D05B 35/08* (2013.01); *D05B 35/107* (2013.01); *D05D 2305/04* (2013.01)

(58) Field of Classification Search
CPC ..... D05B 29/06; D05B 29/08; D05B 29/12; D05B 35/062; D05B 35/08; D05D 2305/04
See application file for complete search history.

(56) References Cited

U.S. PATENT DOCUMENTS

| | | | | | |
|---|---|---|---|---|---|
| 1,850,152 | A * | 3/1932 | La Vigne | D05B 35/062 | 112/137 |
| 2,282,042 | A * | 5/1942 | Enos | D05B 35/02 | 112/141 |
| 2,296,509 | A * | 9/1942 | Enos | D05B 35/02 | 112/141 |
| 2,570,012 | A * | 10/1951 | Temple | D05B 35/062 | 112/63 |
| 2,915,996 | A * | 12/1959 | Charest | D05B 93/00 | 112/122 |
| 3,763,801 | A * | 10/1973 | Bozzi | D05B 35/062 | 112/139 |
| 5,054,407 | A * | 10/1991 | Rowley | D05B 29/00 | 112/136 |
| 6,155,188 | A * | 12/2000 | Henze | D05B 35/02 | 112/141 |
| 6,745,711 | B1 * | 6/2004 | Martelli | D05B 29/08 | 112/151 |

* cited by examiner

*Primary Examiner* — Nathan E Durham
(74) *Attorney, Agent, or Firm* — J. Nevin Shaffer, Jr.

(57) ABSTRACT

A presser foot tube maker apparatus includes a hollow form with a first end and a second end and an inside and an outside and a presser foot configured for attachment to a sewing machine. And an adjustment base is provided where the hollow form is connected with the adjustment base and where the presser foot is connected with the adjustment base such that location of the hollow form and the presser foot relative to the adjustment base is adjustable.

19 Claims, 2 Drawing Sheets

PRESSER FOOT TUBE MAKER APPARATUS AND METHOD

CROSS REFERENCE TO RELATED APPLICATION

This application claims the benefit of previously filed U.S. provisional patent application No. 62/424,412 filed 19 Nov. 2016 for a "Presser Foot Tube Maker Apparatus and Method". The Applicant hereby claims the benefit of this provisional application under 35 U.S.C. § 119. The entire content of this provisional application is incorporated herein by this reference.

FIELD OF THE DISCLOSURE

The present invention pertains to a presser foot tube maker apparatus and method. In one embodiment, a presser foot tube maker apparatus includes a hollow form with a first end and a second end and an inside and an outside and a presser foot configured for attachment to a sewing machine. An adjustment base is provided where the hollow form is connected with the adjustment base and where the presser foot is connected with the adjustment base such that location of the hollow form and the presser foot relative to the adjustment base is adjustable.

BACKGROUND OF THE INVENTION

It is often desirable when sewing material together, for example only and not by way of limitation, to create "tubes" from flat cloth. Straps and piping for dresses and so forth are difficult to make in tube form. The process currently is laborious and uncertain and has two distinct steps: sewing the material together to form the tube and turning the new tube inside out in order to hide the stitching. Presently, both steps are difficult to accomplish, the first because it requires the user to maintain the tube shape manually and the second because currently the user must place the newly created tube on a rigid device and then attempt to peel it over itself in order to place the stitches on the inside.

Thus, there is a need in the art for a device that simplifies both the original stitching and the reversal of the tube once formed.

It therefore is an object of this invention to provide an improved tube creating apparatus and method that is adaptable for use with any sewing machine, that is easy to use and adjustable for various size, length and diameter, tube requirements.

SUMMARY

Accordingly, a presser foot tube maker apparatus includes a hollow form with a first end and a second end and an inside and an outside and a presser foot configured for attachment to a sewing machine. An adjustment base is provided where the hollow form is connected with the adjustment base and where the presser foot is connected with the adjustment base such that location of the hollow form and the presser foot relative to the adjustment base is adjustable.

All terms used herein are given their common meaning such that "presser foot" describes a device for use with sewing machines, for example, for pressing material, fabric and the like, together while stitching the material all as is known to those of ordinary skill in the art.

In another aspect, the apparatus further includes a hollow form adjustment arm with a first end and a second end where the first end of the hollow form adjustment arm is connected with the hollow form and where the second end of the hollow form adjustment arm is connected with the adjustment base. In one aspect, the hollow form adjustment arm surrounds the hollow form and supports the hollow form at the first end of the hollow form.

In one aspect, the invention further includes a material locator connected with the adjustment base and in another, the material locator partially overlaps the hollow form.

In a further aspect, the second end of the hollow form is concave.

In another aspect, the second end of the hollow form is convex.

In one aspect, the hollow form is rectangular in shape along its length.

In yet another aspect, the invention further includes a material pulling device where the material pulling device has a length longer than the hollow form and where the material pulling device includes a material catch at one end and where the material pulling device is configured for insertion into and withdrawal from the hollow form.

According to another embodiment, a presser foot tube maker apparatus includes a hollow form with a first end and a second end and an inside and an outside. A presser foot configured for attachment to a sewing machine and an adjustment base where the hollow form is connected with the adjustment base and where the presser foot is connected with the adjustment base such that location of the hollow form and the presser foot relative to the adjustment base is adjustable. A hollow form adjustment arm with a first end and a second end is provided where the first end of the hollow form adjustment arm is connected with the hollow form and where the second end of the hollow form adjustment arm is connected with the adjustment base. And a material locator connected with the adjustment base.

In one aspect, the hollow form adjustment arm surrounds the hollow form and supports the hollow form at the first end of the hollow form. In one aspect, the material locator partially overlaps the hollow form.

In one aspect, the second end of the hollow form is concave and in another aspect the second end of the hollow form is convex.

In a further aspect, both the hollow form adjustment arm and the material locator are located on the adjustment base at the first end of the hollow form with the presser foot located on the adjustment base after the hollow form adjustment arm and the material locator and closest to the second of the hollow form such that material passes both the hollow form adjustment arm and the material locator prior to being sewed together at the presser foot.

In one aspect, the invention further includes a material pulling device where the material pulling device has a length longer than the hollow form and where the material pulling device includes a material catch at one end and where the material pulling device is configured for insertion into and withdrawal from the hollow form.

According to another embodiment, a presser foot tube maker method consists of:

a. providing a hollow form with a first end and a second end and an inside and an outside; a presser foot configured for attachment to a sewing machine; an adjustment base where the hollow form is connected with the adjustment base and where the presser foot is connected with the adjustment base such that location of the hollow form and the presser foot relative to the adjustment base is adjustable;

b. connecting the presser foot, with the adjustment base and the hollow form, to a sewing machine;

c. wrapping material around the hollow form at the first end of the hollow form; and d. operating the sewing machine while moving the material from the first end of the hollow form to the second end of the hollow form.

In one aspect, the method further includes:

a. a material pulling device where the material pulling device has a length longer than the hollow form and where the material pulling device includes a material catch at one end and where the material pulling device is configured for insertion into and withdrawal from the hollow form; and b. inserting the material pulling device in the hollow form and using the material catch to pull the material through the hollow form from the second end to the first end.

In another aspect, the method further includes providing a material locator connected with the adjustment base where the material locator holds fabric in position with the hollow form. In one aspect, the material locator partially overlaps the hollow form.

DESCRIPTION OF THE DRAWINGS

Other objects, features and advantages of the present invention will become more fully apparent from the following detailed description of the preferred embodiment, the appended claims and the accompanying drawing in which:

DETAILED DESCRIPTION OF EMBODIMENTS

Figure 1:
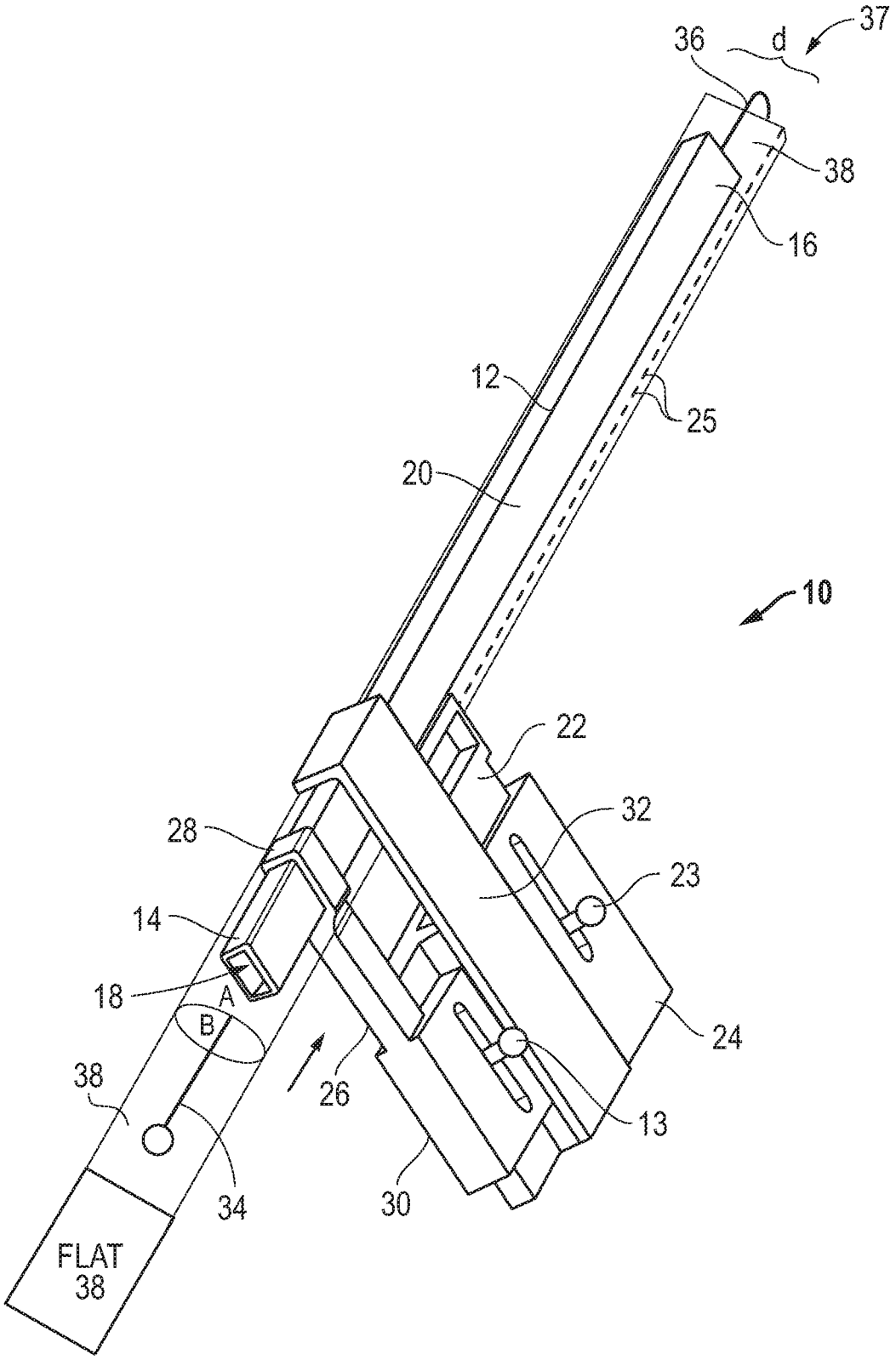
FIG. 1 is a perspective view of the presser foot tube maker apparatus of the present invention according to one embodiment shown with the presser foot close to the hollow form to make small tubes of material.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process or arrangement of the elements of the invention may be altered so that certain processes are conducted in parallel or independent, with other processes, to the extent that the processes are not dependent upon each other. Thus, the specific order of steps or elements described herein is not to be considered implying a specific sequence of steps to perform the process. In alternative embodiments, one or more process steps may be implemented by a user assisted process and/or manually. Other alterations or modifications of the above processes are also contemplated. For example, further insubstantial approximations of the process are also considered within the scope of the processes described herein.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware and software based devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

One embodiment of the present invention is illustrated by way of example in FIGS. 1-4. With specific reference to FIG. 1, presser foot tube maker apparatus 10 includes hollow form 12. Hollow form 12 includes first end 14, second end 16, inside 18 and outside 20. Hollow form 12 may be in any shape but Applicant has found the rectangular shape is preferred as it provides a definite extended flat side against which other elements of the invention may be accurately placed as desired, all as described more fully hereafter.

A presser foot 22 is provided. Presser foot 22 is shown schematically for clarity. Presser feet are known and ubiquitous in the sewing art and presser foot 22 is not described more fully hereafter. Importantly, it should be understood that presser foot 22 is located or positioned in the apparatus such that material 38 is introduced to it in "un-stitched" form. That is, material 38 is a flat unformed material prior to passing underneath presser foot 22, again, as is known in the art. Thereafter it is stitched together as indicated in the figures by stitches 25.

Figures 2, 3, 4:
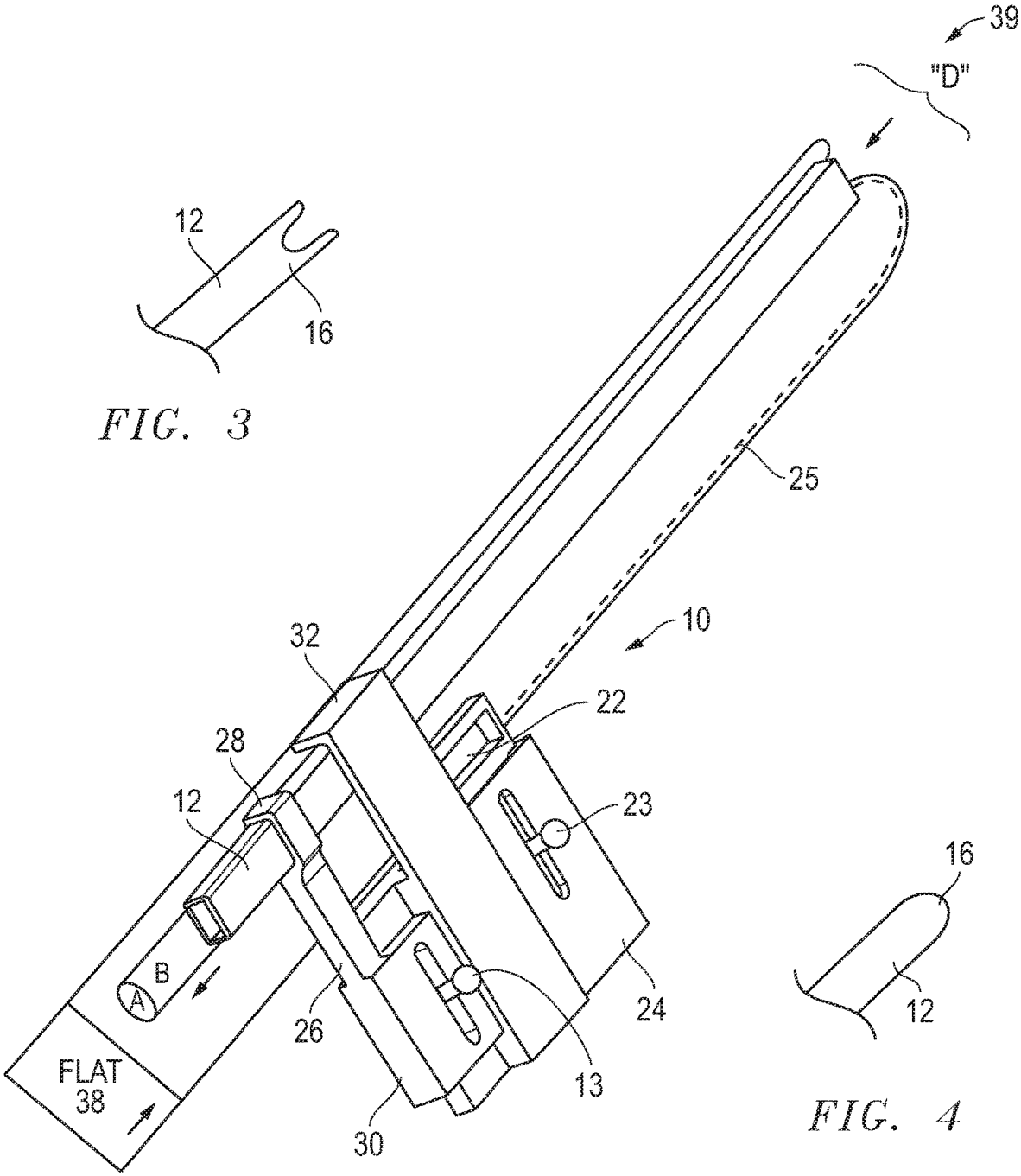
FIG. 2 is a perspective of the invention of FIG. 1 with the presser foot adjusted further away from the hollow form to make larger tubes of material.
FIG. 3 is a top view of the invention of FIG. 1 showing a hollow form with a convex second end.
FIG. 4 is a top view of the invention of FIG. 1 showing a hollow form with a concave second end.

Adjustment base 24 is provided and hollow form 12 is connected to adjustment base 24 as is presser foot 22. Adjustment base 24 enables the user to change the position of both the presser foot 22 with adjustment knob 23 and hollow form 12 with adjustment knob 13, either closer to adjustment base 24 or farther away, so as to make material into small diameter tubes (FIG. 1) or larger diameter tubes (FIG. 2). Preferably hollow form 12 is attached to adjustment base 24 by means of hollow form adjustment arm 26. Hollow form adjustment arm 26 has a first end 28 and a second end 30. Preferably, first end 28 is connected to hollow form 12 and second end 30 is adjustably connected with adjustment base 24 as illustrated. Applicant has found that significant stabilizing support is provided when the first end 28 of hollow form adjustment arm 26 fully encompasses hollow form 12 as shown at the first end 14. The preferred rectangular shape of hollow form 12 also provides significant contact and support faces for a first end 28 that mirrors the rectangular shape.

FIG. 1 shows the use of adjustment base 24 in positioning both the presser foot 22 and the hollow form 12 such that a small diameter "d" tube 37 is created from material 38 as compared to FIG. 2 where they are positioned so as to create large diameter "D" tubes 39.

Still referring to FIGS. 1 and 2, material locator 32 is provided to trap the fabric/material close to hollow form 12 and to maintain that position while sewing without further attention by the user. In a preferred embodiment, material locator 32 partially surrounds hollow form 12 as shown. Material 38 is placed between hollow form 12 and material locator 32 as can be understood. The process may be that the user first places material 38 over hollow form 12 and then places material locator 32 over material 38 and hollow form 12 and, again, "traps" the material close to hollow form 12 while allowing material 38 to pass by it on the way to presser foot 22. Again, prior to presser foot 22, material 38 which begins as a flat sheet of material is simply folded around hollow form 12 and thus is able to pass by hollow form adjustment arm 26 and, when present, material locator 32.

FIG. 1 illustrates material pulling device 34. Material pulling device 34 is a device designed to be used in conjunction with the previously described elements of the present invention in order to accomplish the second objective of turning a tube of material inside out after stitching such that the stitches are on the inside of the tube.

As clearly illustrated, material pulling device 34 has a length greater than the length of hollow form 12. Material pulling device has a material catch 36. In use, once the user has stitched enough material 38 to pass the second end 16 of hollow form 12, material pulling device is inserted into the inside 18 of hollow form 12 until material catch 36 passes the end of the stitched material as shown. At that point, material 38 has an "A" side and a "B" side with the stitching exposed. As the user catches the "A" side and pulls the material 38 into hollow form 12, the material 38 is turned inside out automatically. The result, as shown in FIG. 2 is that the "B" side is now exposed, and the "A" side with the stitching is hidden. Thereafter, with the leading end of the now reversed material 38 exiting from the inside 18 of hollow form 12 at the first end 14, the user can remove the material pulling device 34 and simply pull the material 38 by hand such that the material 38 is formed into a tube of any desired length and the tube reversed all in one continuous movement. That is, once the reversed tube of material has been pulled out of the first end 14 of hollow form 12, the user can simply pull the material by hand. This automatically feeds unsown material 38 to be stitched at presser foot 22 and reverses material 38 such that a fully stitched and reversed material 38 is obtained in one motion. This is a significant time and money saving improvement over the art.

Referring now to FIGS. 3 and 4, in FIG. 3, the second end 16 of hollow form 12 is convex and in FIG. 4 the second end 16 is concave. When, as described above, material 38 is pulled into hollow form 12 with the FIG. 3 convex shape, the material 38 is introduced seam first and then side into hollow form 12. When the second end 16 is concave shaped, the material 38 is introduced side first and then seam. These forms are designed to meet user needs and preferences depending on material 38 used and form desired.

While the invention has been described in relation to material such as fabric for clothing, certainly the elements of the invention may be used for the construction of tube forms for any useful material as is now known or hereafter developed, The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A presser foot tube maker apparatus comprising:

a. a hollow form with an open first end and an open second end and an inside and an outside;

b. a presser foot configured for attachment to a sewing machine;

c. an adjustment base wherein said hollow form is attached to and connected with said adjustment base and wherein said presser foot is connected with said adjustment base such that location of said hollow form and said presser foot relative to said adjustment base are individually and separately adjustable; and d. a hollow form adjustment arm with a first end and a second end wherein said first end of said hollow form adjustment arm is attached to and connected with said hollow form and wherein said second end of said hollow form adjustment arm is attached to and connected with said adjustment base wherein the hollow form adjustment arm completely surrounds said hollow form and supports said hollow form at said open first end of said hollow form.

2. The apparatus of claim 1 further including a material locator connected with said adjustment base.

3. The apparatus of claim 2 wherein said material locator partially overlaps said hollow form.

4. The apparatus of claim 1 wherein said second end of said hollow form is concave.

5. The apparatus of claim 1 wherein said second end of said hollow form is convex.

6. The apparatus of claim 1 wherein the hollow form is rectangular in shape along its entire length.

7. The apparatus of claim 1 further including a material pulling device wherein said material pulling device has a length longer than said hollow form and wherein said material pulling device includes a material catch at one end and wherein said material pulling device is configured for insertion into and withdrawal from said hollow form.

8. A presser foot tube maker apparatus comprising:

a. a hollow form with an open first end and an open second end and an inside and an outside;

b. a presser foot configured for attachment to a sewing machine;

c. an adjustment base wherein said hollow form is attached to and connected with said adjustment base and wherein said presser foot is connected with said adjustment base such that location of said hollow form and said presser foot relative to said adjustment base are individually and separately adjustable;

d. a hollow form adjustment arm with a first end and a second end wherein said first end of said hollow form adjustment arm is attached to and connected with said hollow form and wherein said second end of said hollow form adjustment arm is connected with said adjustment base wherein the hollow form adjustment arm completely surrounds said hollow form and supports said hollow form at said first end of said hollow form; and e. a material locator connected with said adjustment base such that the material locator partially overlaps said hollow form.

9. The apparatus of claim 8 wherein said second end of said hollow form is concave.

10. The apparatus of claim 8 wherein said second end of said hollow form is convex.

11. The apparatus of claim 8 wherein both the hollow form adjustment arm and the material locator are located on said adjustment base at said first end of said hollow form with said presser foot located on said adjustment base after the hollow form adjustment arm and the material locator and closest to said second of said hollow form.

12. The apparatus of claim 8 further including a material pulling device wherein said material pulling device has a length longer than said hollow form and wherein said material pulling device includes a material catch at one end and wherein said material pulling device is configured for insertion into and withdrawal from said hollow form.

13. The apparatus of claim 8 wherein the hollow form is rectangular in shape along its entire length.

14. A presser foot tube maker method comprising:

a. providing a hollow form with an open first end and an open second end and an inside and an outside wherein the hollow form is rectangular in shape along its entire length; a presser foot configured for attachment to a sewing machine; an adjustment base wherein said hollow form is attached to and connected with said adjustment base and wherein said presser foot is connected with said adjustment base such that location of said hollow form and said presser foot relative to said adjustment base are individually and separately adjustable;

b. connecting said presser foot, with said adjustment base and said hollow form, to a sewing machine;

c. wrapping material around said hollow form at said open first end of said hollow form; and d. operating said sewing machine while moving said material from said open first end of said hollow form to said open second end of said hollow form.

15. The method of claim 14 further including:

a. a material pulling device wherein said material pulling device has a length longer than said hollow form and wherein said material pulling device includes a material catch at one end and wherein said material pulling device is configured for insertion into and withdrawal from said hollow form; and b. inserting said material pulling device in said hollow form and using said material catch to pull said material through said hollow form from said open second end to said open first end.

16. The method of claim 14 further including providing a material locator connected with said adjustment base wherein said material locator holds fabric in position with said hollow form.

17. The method of claim 16 wherein said material locator partially overlaps said hollow form.

18. A presser foot tube maker apparatus comprising:

a. a hollow form with an open first end and an open second end and an inside and an outside wherein the hollow form is rectangular in shape along its entire length;

b. a presser foot configured for attachment to a sewing machine;

c. an adjustment base wherein said hollow form is attached to and connected with said adjustment base and wherein said presser foot is connected with said adjustment base such that location of said hollow form and said presser foot relative to said adjustment base are individually and separately adjustable.

19. A presser foot tube maker apparatus comprising:

a. a hollow form with an open first end and an open second end and an inside and an outside;

b. a presser foot configured for attachment to a sewing machine;

c. an adjustment base wherein said hollow form is attached to and connected with said adjustment base and wherein said presser foot is connected with said adjustment base such that location of said hollow form and said presser foot relative to said adjustment base are individually and separately adjustable;

d. a hollow form adjustment arm with a first end and a second end wherein said first end of said hollow form adjustment arm is attached to and connected with said hollow form and wherein said second end of said hollow form adjustment arm is connected with said adjustment base wherein the hollow form is rectangular in shape along its entire length; and e. a material locator connected with said adjustment base such that the material locator partially overlaps said hollow form.

* * * * *